US012636541B2

(12) United States Patent
Byun

(10) Patent No.: US 12,636,541 B2
(45) Date of Patent: May 26, 2026

(54) AUTO-ROTATING HANDLE

(71) Applicant: Newtech wellness Corporation, Gimhae-si (KR)

(72) Inventor: Hyun Jung Byun, Busan (KR)

(73) Assignee: Newtech wellness Corporation, Gimhae-si (KR)

( * ) Notice: Subject to any disclaimer, the term of this patent is extended or adjusted under 35 U.S.C. 154(b) by 213 days.

(21) Appl. No.: 18/105,264

(22) Filed: Feb. 3, 2023

(65) Prior Publication Data

US 2024/0165457 A1 May 23, 2024

(30) Foreign Application Priority Data

Nov. 18, 2022 (KR) ..... 10-2022-0155519
Jan. 20, 2023 (KR) ..... 10-2023-0008503

(51) Int. Cl.
*A63B 21/00* (2006.01)

(52) U.S. Cl.
CPC ..... *A63B 21/4035* (2015.10); *A63B 21/151* (2013.01); *A63B 2225/09* (2013.01)

(58) Field of Classification Search
CPC . A63B 21/0628; A63B 21/151; A63B 21/152; A63B 21/154; A63B 21/159; A63B 21/4035; A63B 21/4047; A63B 21/4049; A63B 23/0233; A63B 23/03533; A63B 23/1209
See application file for complete search history.

(56) References Cited

U.S. PATENT DOCUMENTS 5,116,297 A * 5/1992 Stonecipher ..... A63B 21/4035 482/137
5,971,896 A * 10/1999 Giannelli ..... A63B 23/1209 482/136
6,071,216 A * 6/2000 Giannelli ..... A63B 21/4035 482/136
6,254,516 B1 * 7/2001 Giannelli ..... A63B 23/1209 482/136
2003/0166439 A1 * 9/2003 Giannelli ..... A63B 23/12 482/136

FOREIGN PATENT DOCUMENTS

KR 10-0905049 B1 6/2009

* cited by examiner

*Primary Examiner* — Megan Anderson
(74) *Attorney, Agent, or Firm* — Revolution IP, PLLC

(57) ABSTRACT

According to an embodiment of the present disclosure, the auto-rotating handle that allows the user to lift the weight by pulling the lever connected to the weight may include a rotation transmitting unit that is connected to the support frame in a rotatable fashion, a lever unit that is connected on one-end of the rotation transmitting unit and provides the user a space to grip on, a cable that connects the rotation transmitting unit and the weight, and a lever rotation unit that is connected to the support frame in a rotatable fashion and interlocked to a rotation of the rotation transmitting unit, and allows the lever unit to rotate around the rotation transmitting unit according to the degree of the rotation of the rotation transmitting unit.

5 Claims, 12 Drawing Sheets

【Figure 1】
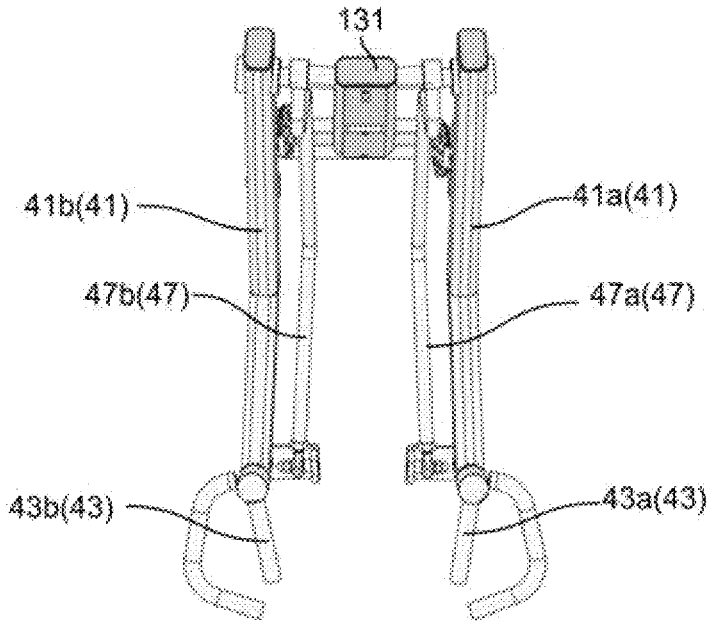
(a)
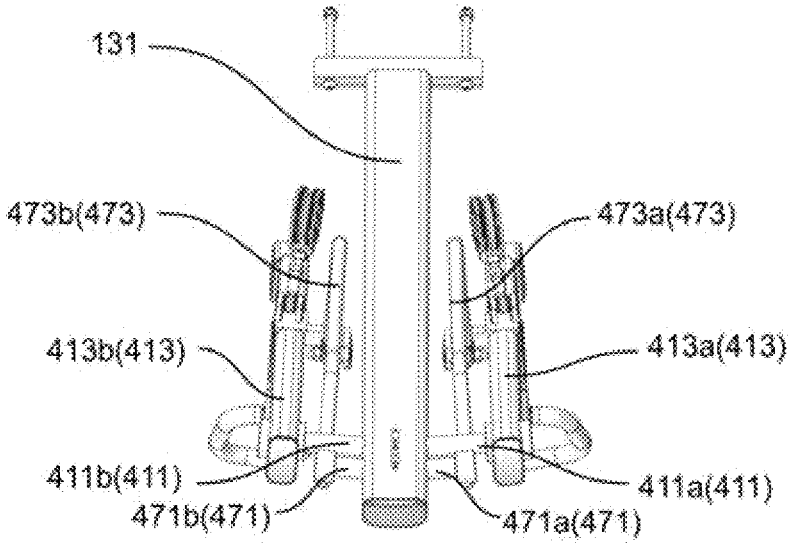
(b)

【Figure 2】
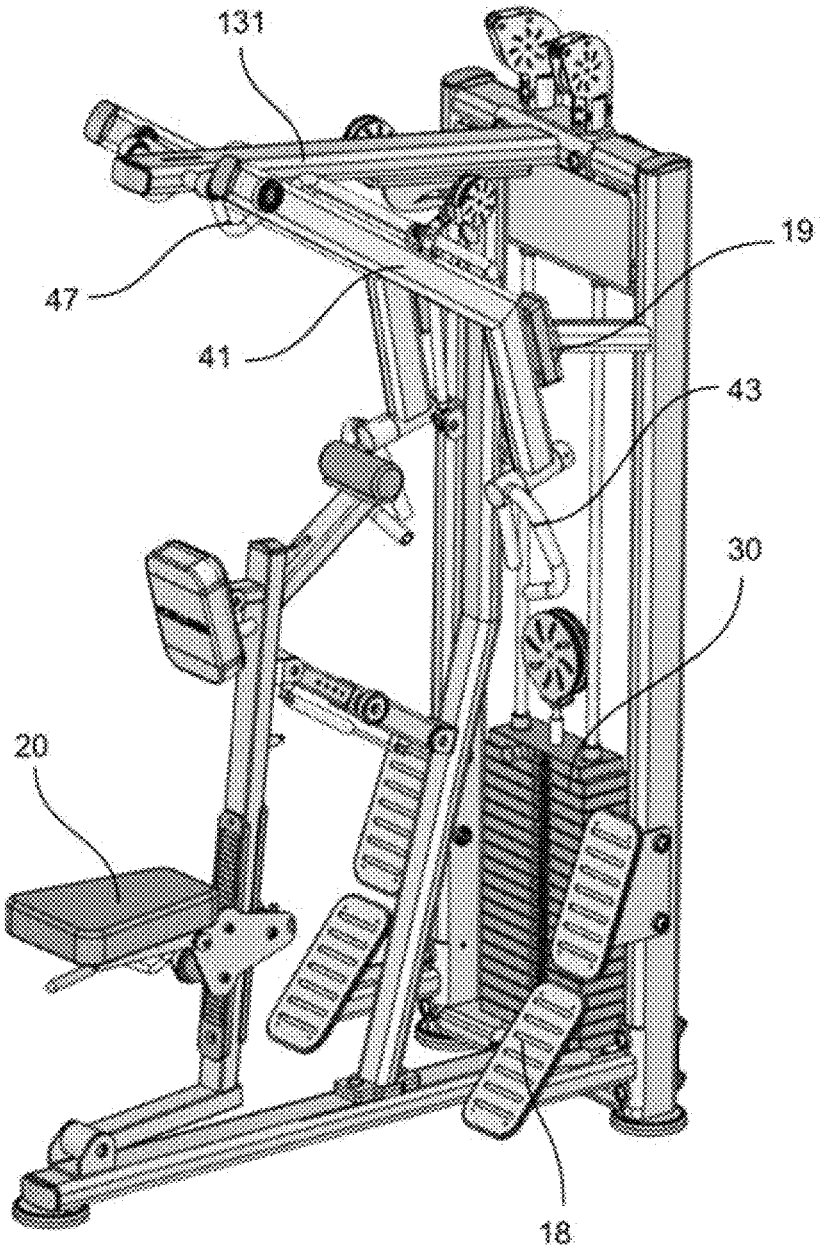

【Figure 3】
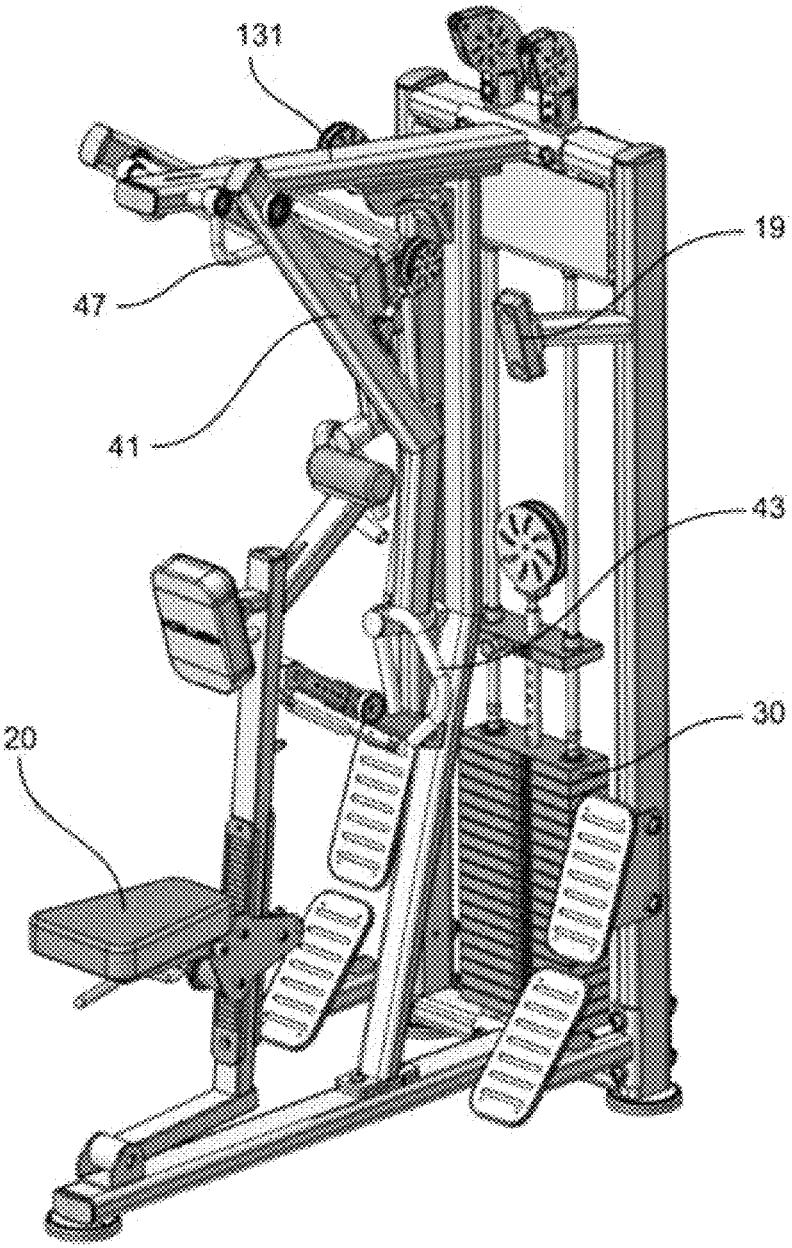

【Figure 4】
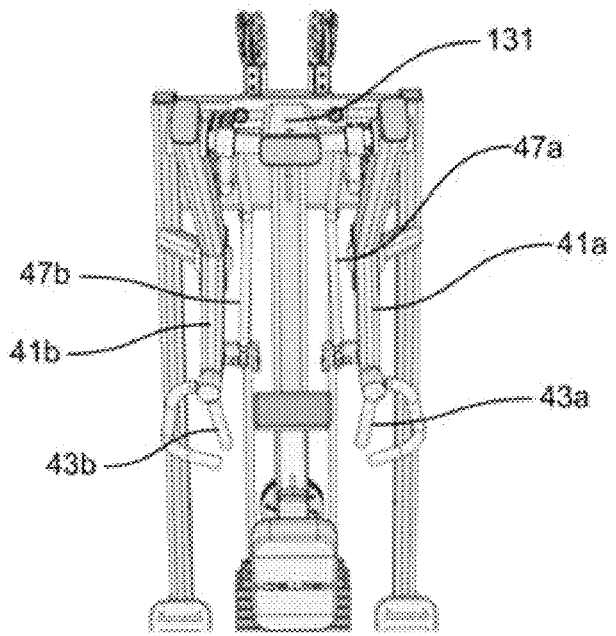
(a)
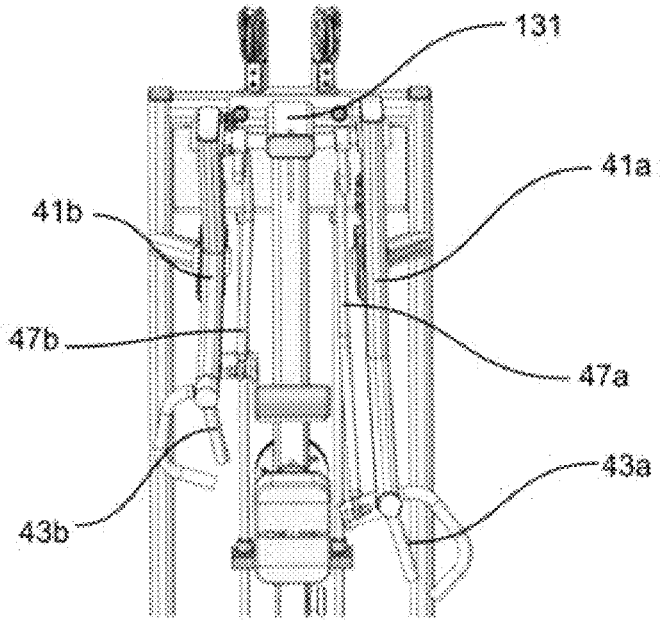
(b)

【Figure 5】
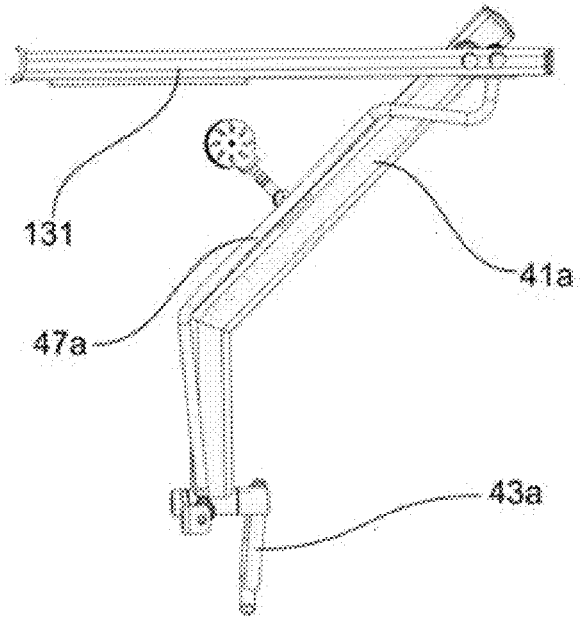
(a)
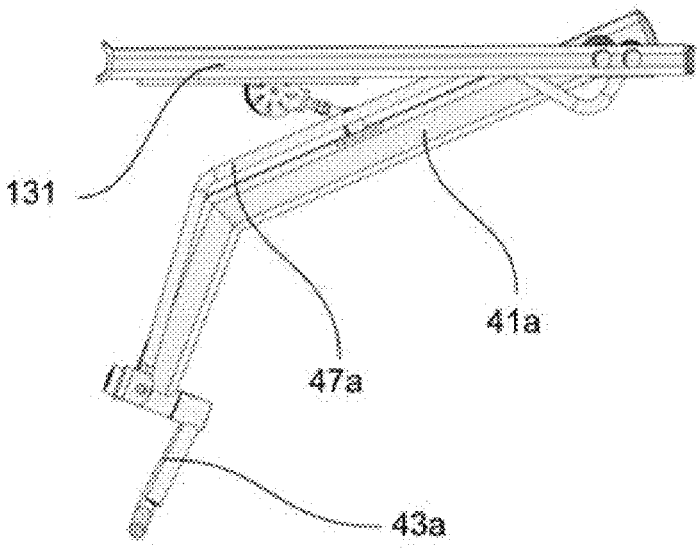
(b)

【Figure 6】
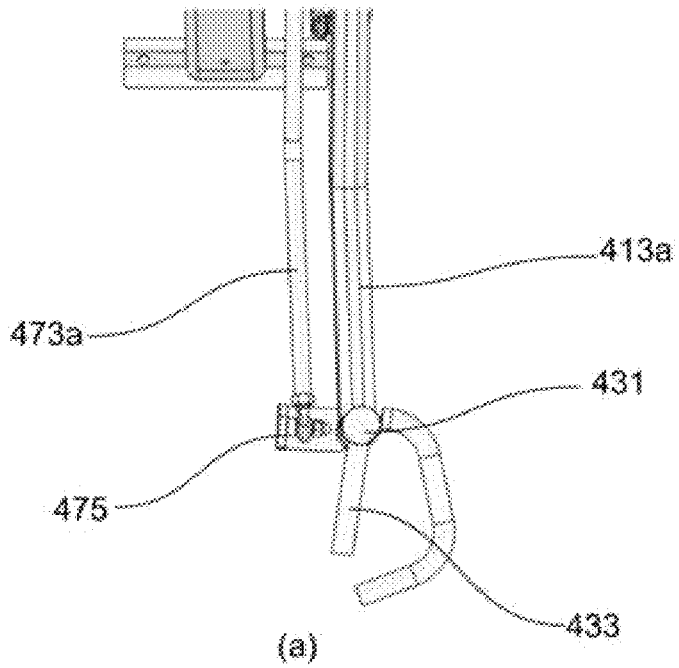
(a)
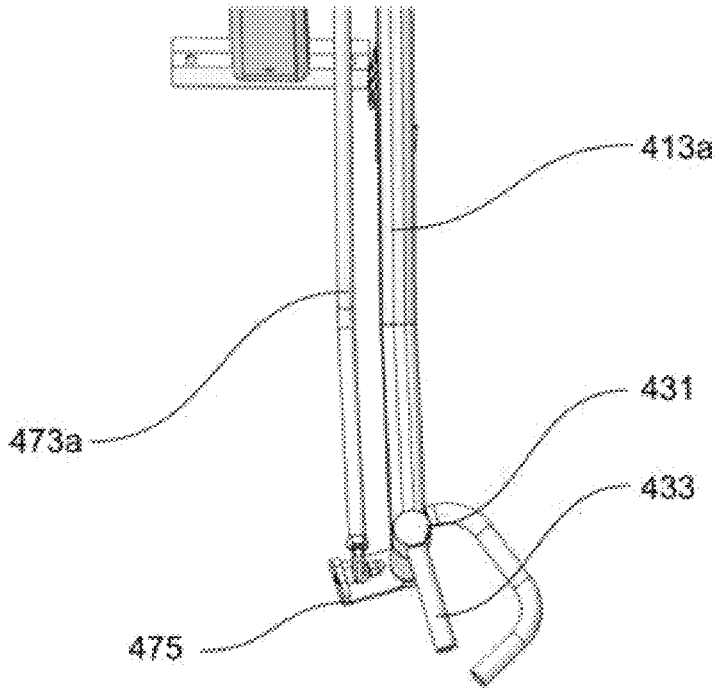
(b)

【Figure 7】
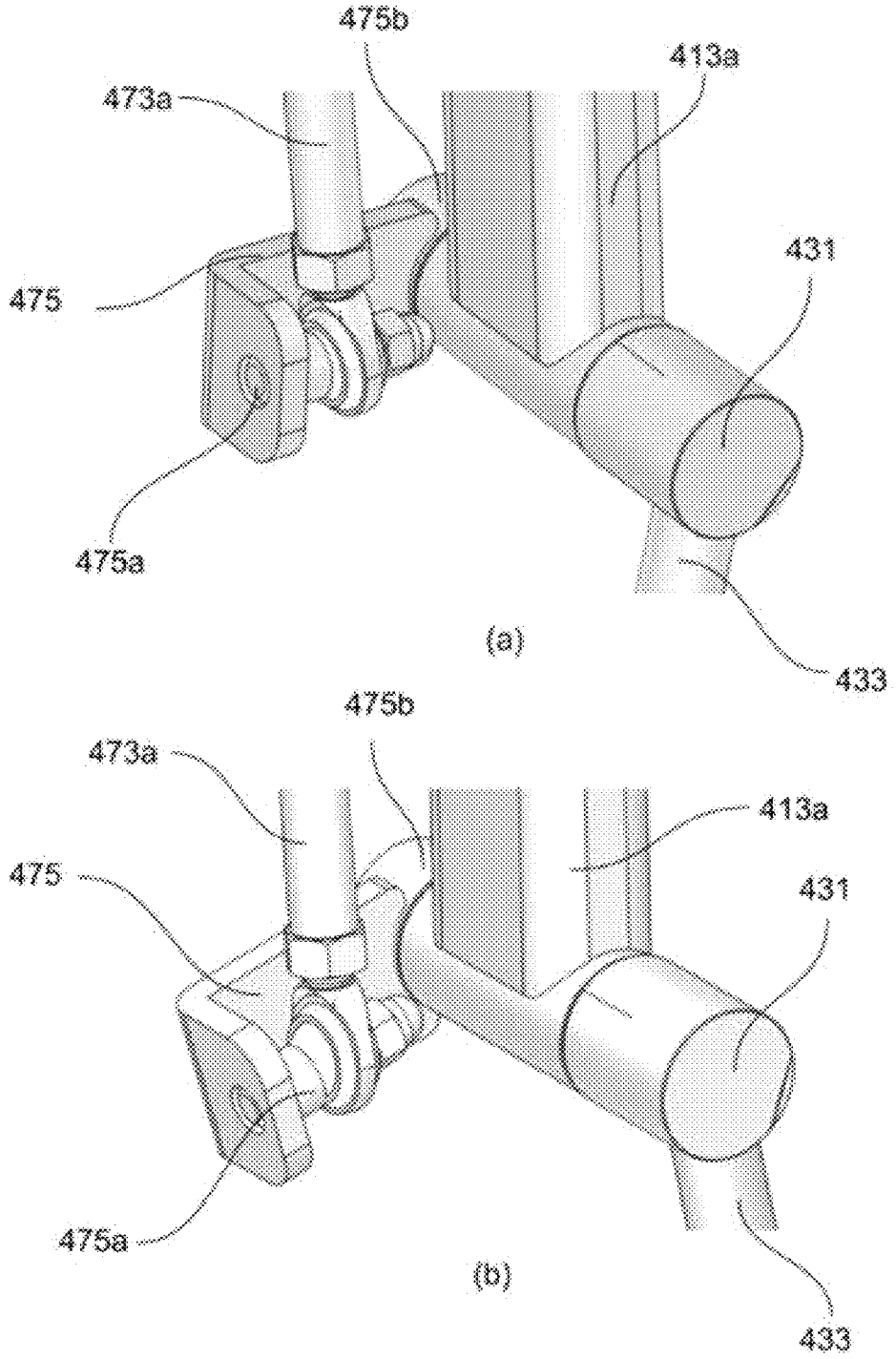

【Figure 8】
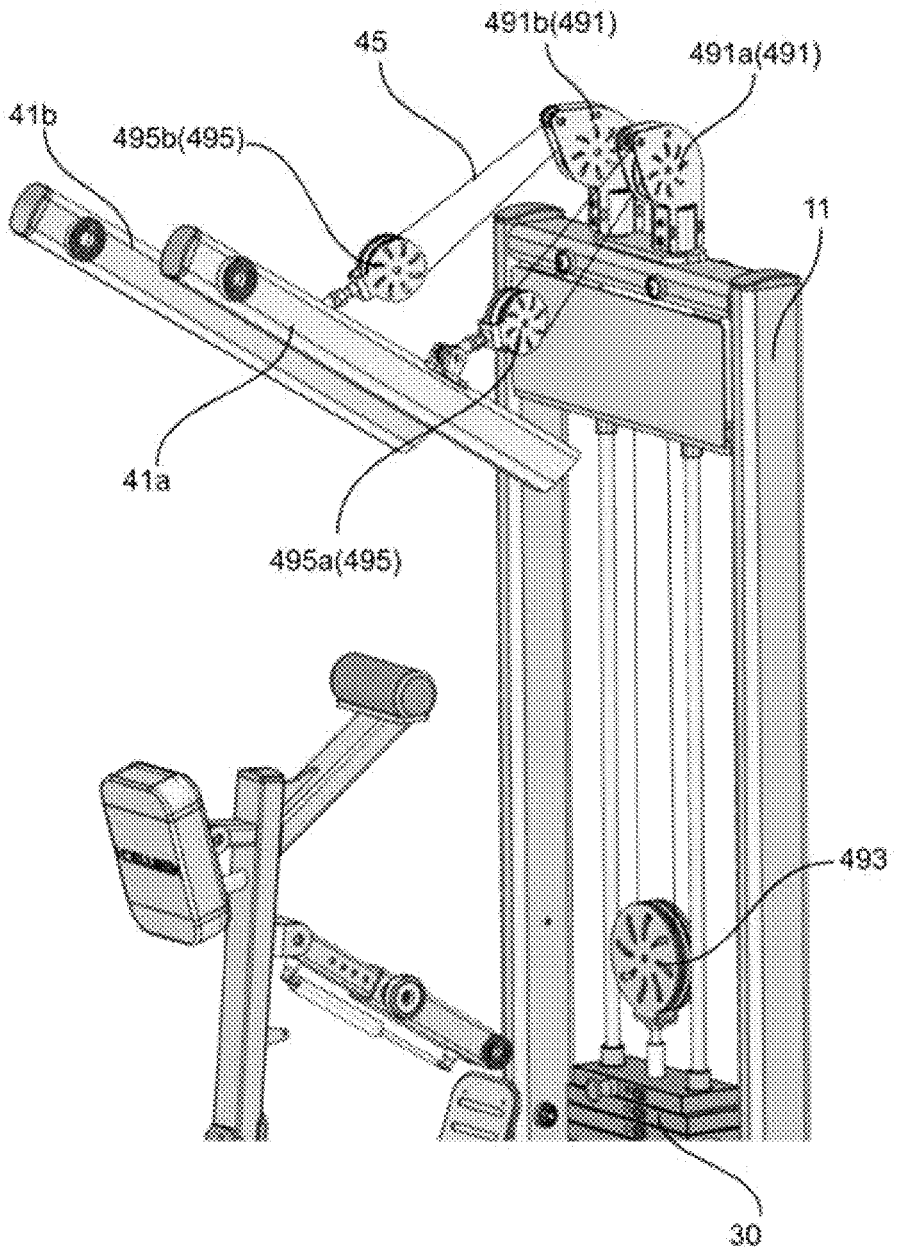

【Figure 9】
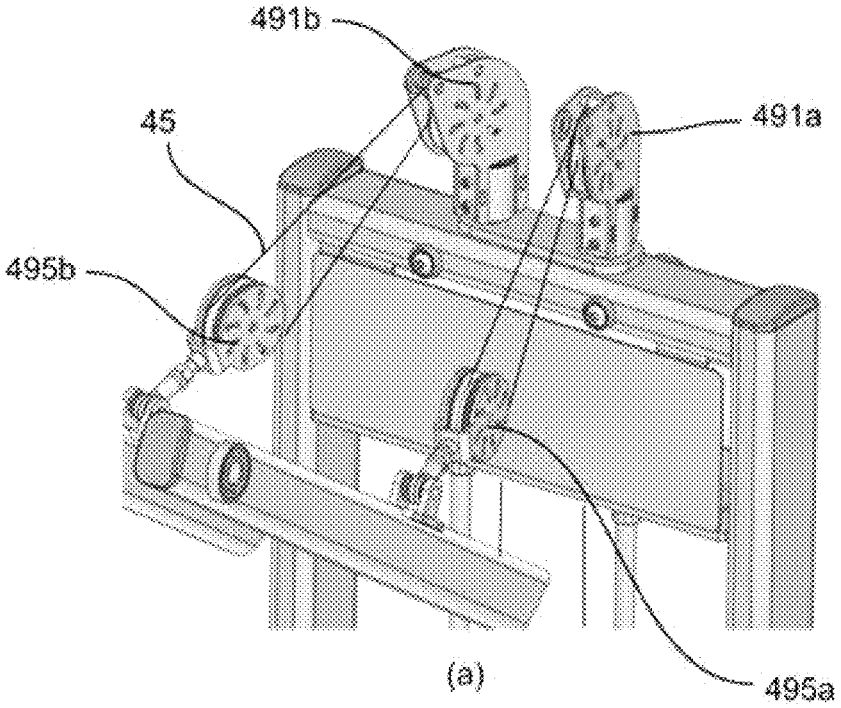
(a)
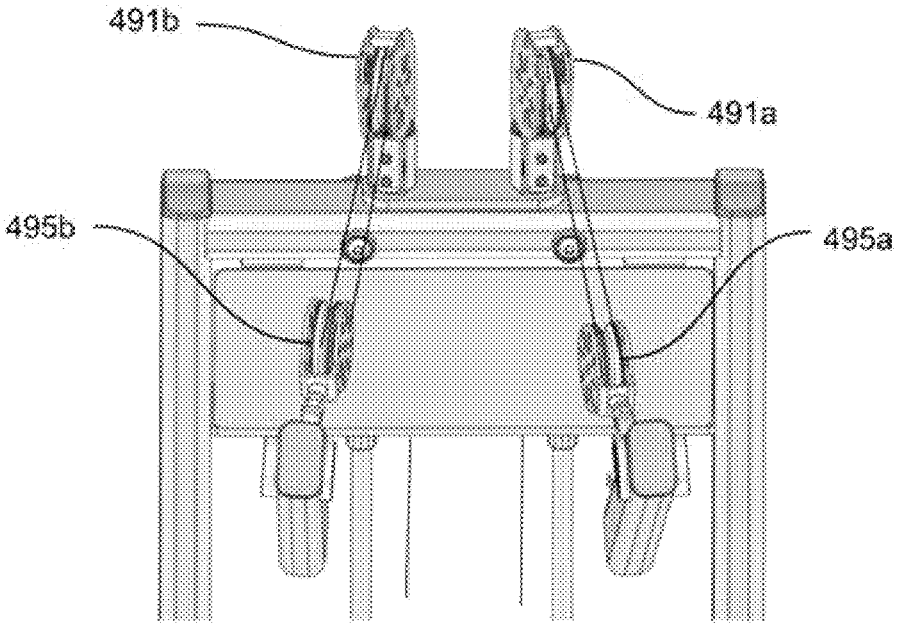
(b)

【Figure 10】
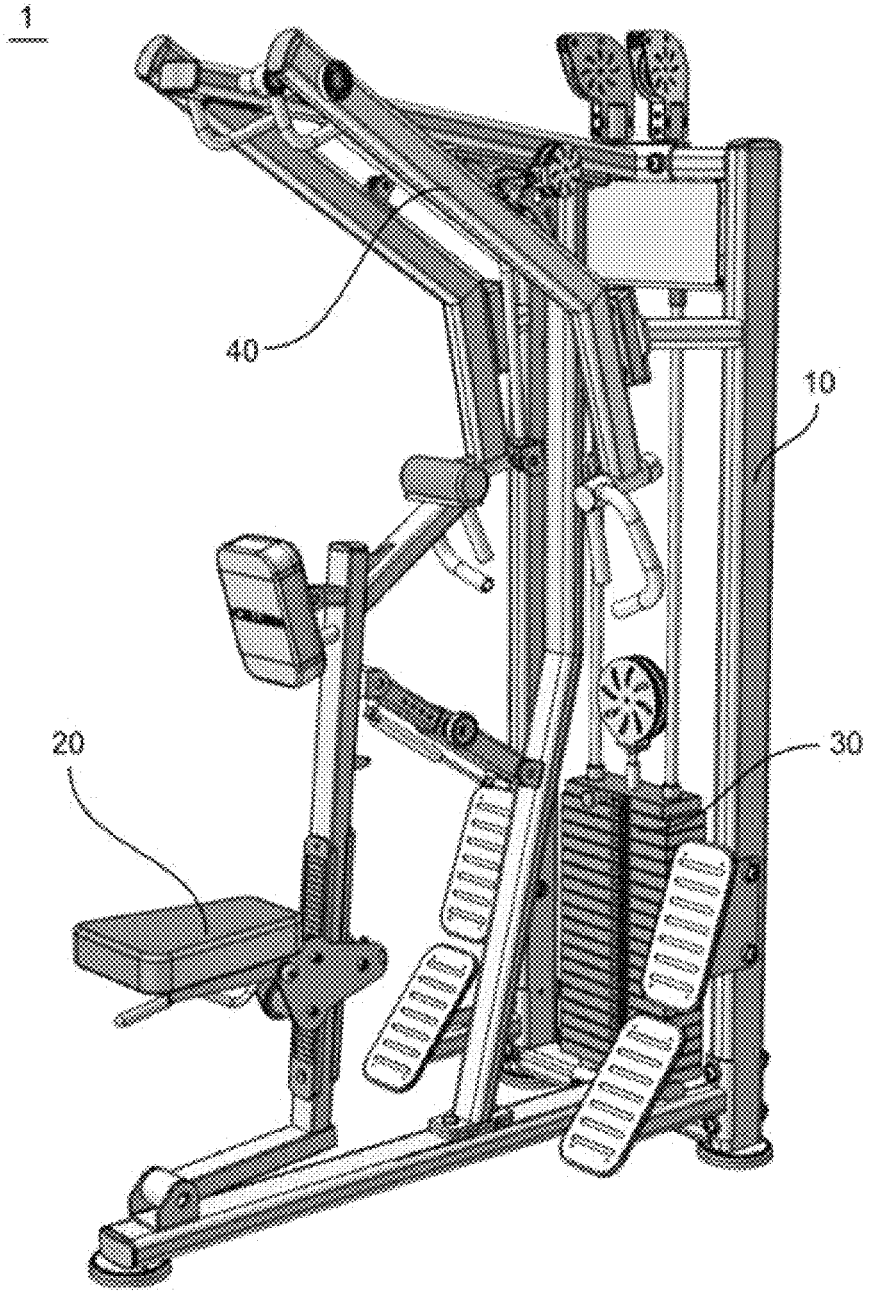

【Figure 11】
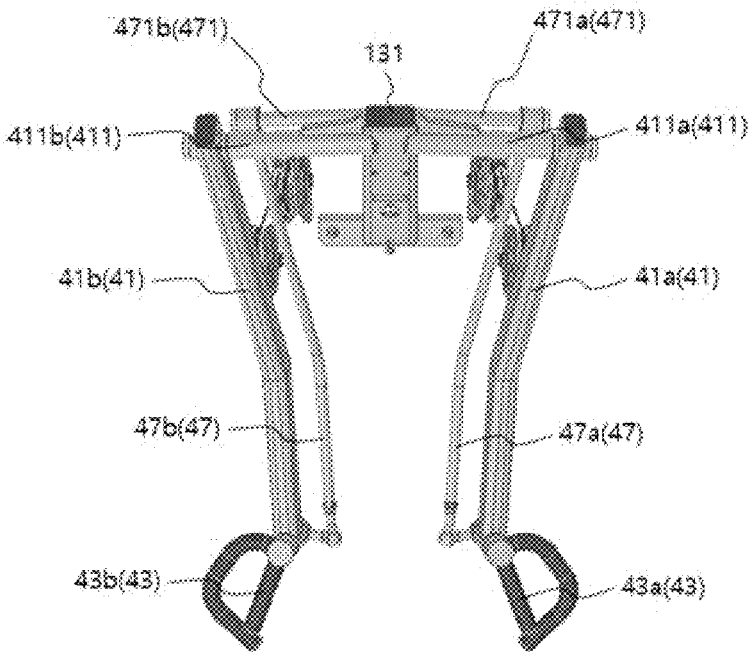
(a)
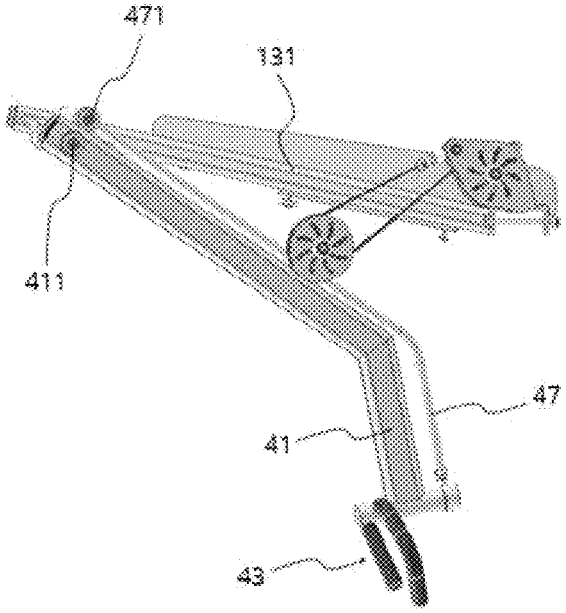
(b)

【Figure 12】
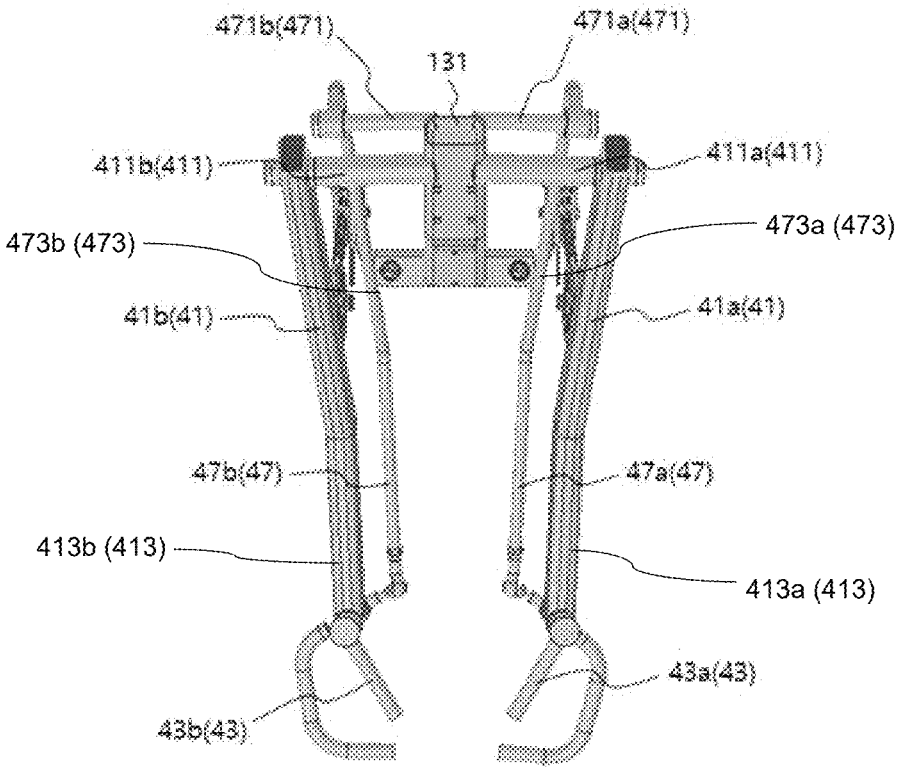
(a)
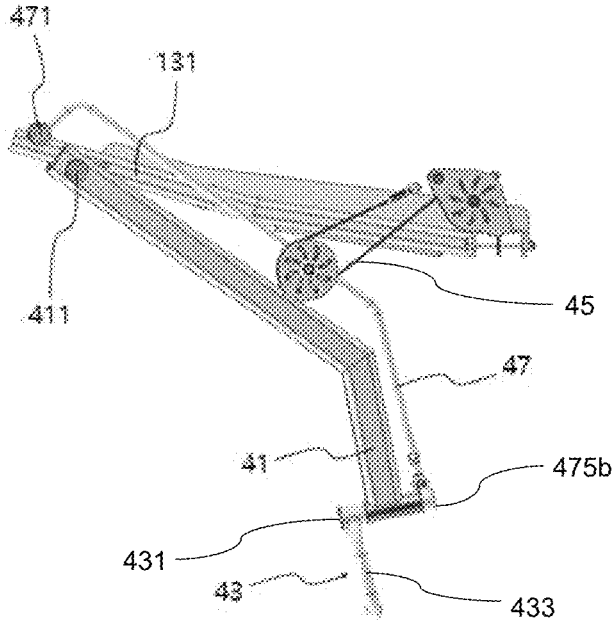
(b)

AUTO-ROTATING HANDLE

FIELD OF THE DISCLOSURE

The present disclosure relates to an auto-rotating handle that rotates while a user pulls a lever connected to a weight and minimizes discomfort from spreading arms and hands.

BACKGROUND OF THE DISCLOSURE

As of late, social interest in beauty and health has increased, and as a result, there are more people investing in weight training to improve their strength and build a well-proportioned figure. Weight training is a form of exercise using objects of weight such as barbells and dumbbells to build muscles and subsequently improve physical strength.

In weight training, various exercises such as, bench presses, squats, and deadlifts are included, and fitness clubs furnish various fitness training equipment to execute such exercises.

However, various conventional fitness training equipment has fixed levers as their handles and caused discomfort to their users by making the users spread their arms and hands when pulling the handles.

Therefore, a study on the auto-rotating handle that rotates while the user pulls the lever connected to the weight and minimizes the discomfort from spreading the arms and the hands is required.

PRIOR ARTS

Patent Document (Patent Document 1) Korean Patent No. 10-0905049

SUMMARY OF DISCLOSURE

Technical Problem

It is an object of the present disclosure to provide the auto-rotating handle that rotates while the user pulls the lever connected to the weight and enables effective exercises by stimulating specific areas of the body.

Technical Solution

According to an embodiment of the present disclosure, the auto-rotating handle that allows the user to lift the weight by pulling the lever connected to the weight may include a rotation transmitting unit that is connected to the support frame in a rotatable fashion, a lever unit that is connected on one end of the rotation transmitting unit and provides the user a space to grip on, a cable that connects the rotation transmitting unit and the weight, and a lever rotation unit that is connected to the support frame in a rotatable fashion and interlocked to a rotation of the rotation transmitting unit, and allows the lever unit to rotate around the rotation transmitting unit according to the degree of the rotation of the rotation transmitting unit.

According to another embodiment of the present disclosure, the rotation transmitting unit may include a delivery shaft that can be mounted on the support frame, and a delivery bar of which one-end is connected to the delivery shaft in a rotatable fashion and the other end is left unconnected. And the lever rotation may include a lever rotation shaft that can be mounted on the support frame, include a lever interlocking bar that is connected to the lever rotation shaft in a rotatable fashion, and a link unit that connects the lever interlocking bar and the delivery bar.

According to still another embodiment of the present disclosure, the link unit may form an intermediate shaft that the lever interlocking bar is connected in a rotatable fashion, and a grip shaft that the lever unit is connected in a rotatable fashion, and allow the lever interlocking bar to rotate according to the degree of the rotation of the delivery bar. Herein, the lever unit may include a shaft connection unit that is connected to the grip shaft; and include a grip unit that is extended from the shaft connection unit and provides a grip space for the user.

According to still another embodiment of the present disclosure, the delivery bar may be rotate to a rotated position from a standby position while external force is applied, and rotate back to the standby position from the rotated position by the weight when the external force is not applied. Herein, the standby position is where the delivery bar is located when there is no external force, and the rotated position is where the delivery bar is located after being rotated around the delivery shaft while being pulled by the user. And the link unit may rotate according to the change in distance cause by differences between the rotation path of the delivery bar that rotate around the delivery shaft and the lever interlocking bar that rotate around the lever rotation shaft.

According to still another embodiment of the present disclosure, the lever unit may rotate toward an outer direction if the length of the lever rotation unit is longer than the length set prior.

According to still another embodiment of the present disclosure, the lever unit may rotate toward an inner direction if the length of the lever rotation unit is shorter than the length set prior.

Advantageous Effects

The present disclosure provides an auto-rotating handle which rotates while the user pulls a lever connected to a weight thus to enable more effective exercises by stimulating specific areas of a body.

BRIEF DESCRIPTION OF THE DRAWINGS

FIG. 1 is a drawing representing the auto-rotating handle according to the first embodiment of the present disclosure.

FIGS. 2 through 6 are drawings representing the standby position and rotated position of the auto-rotating handle according to an embodiment of the present disclosure.

FIG. 7 is a drawing representing the rotation of the link according to an embodiment of the present disclosure.

FIGS. 8 and 9 are drawings representing the delivery pulley and cable according to an embodiment of the present disclosure.

FIG. 10 is a drawing representing the exercise equipment (seated row) according to an embodiment of the present disclosure.

FIG. 11 is a drawing representing the auto-rotating handle according to the second embodiment of the present disclosure.

FIG. 12 is a drawing representing the auto-rotating handle according to the third embodiment of the present disclosure.

DETAILED DESCRIPTION OF THE PREFERRED EMBODIMENTS

References will be now made to the drawings to explain the specific embodiments of the present disclosure in detail.

However, the technical ideas of the present disclosure shall not be limited to the embodiments presented, and it will be understood by those skilled in the technical field to which the present disclosure belongs to that while any addition, change, deletion, etc. of other elements within the same scope of technical idea may easily facilitate suggestion of other retrograde disclosures or another embodiment included within the scope of the technical idea for the present disclosure, such addition, change, deletion, etc. belong to the claims of the present disclosure.

Also, elements with identical functions within the scope of the identical technical idea illustrated in the drawings of respective embodiment will be described by using the same reference numerals.

The auto-rotating handle 40, as illustrated in FIG. 10, is connected to the support frame 10 in a rotatable fashion and to the weight 30, and allows the weight 30 to be raised by the external force applied by the user sitting on the seat 20.

More specifically, the auto-rotating handle 40 may be equipped with the rotation transmitting unit 41, lever unit 43, cable 45, and lever rotation unit 47.

The rotation transmitting unit 41 may be connected to the upper frame 131 of the support frame 10 in a rotatable fashion.

The rotation transmitting unit 41 may consist of the first rotation transmitting arm 41*a* and second rotation transmitting arm 41*b* arranged in mirroring position.

The first rotation transmitting arm 41*a* and second rotation transmitting arm 41*b* may operate independently.

The lever unit 43 is mounted at the lower end of the rotation transmitting unit 41 and may provide a space for the user to grip on. The user can grip on to the lever unit 43 and rotate the rotation transmitting unit 41 to raise the weight 30 connected to the rotation transmitting unit 41.

The cable 45 may connect the rotation transmitting unit 41 and weight 30. Regarding the cable 45, details will be explained in FIGS. 8 and 9.

The lever rotation unit 47 shall be connected to the upper frame 131 of the support frame 10 in a rotatable fashion, but interlocked with the rotation transmitting unit 41, and the lever unit 43 shall rotate according to the degree of the rotation of the rotation transmitting unit 41.

The lever rotation unit 47 may consist of the first lever rotation arm 47*a* and second lever rotation arm 47*b* arranged in mirroring position.

The first lever rotation arm 47*a* may pair up and interlock with the first rotation transmitting arm 41*a*, and the second lever rotation arm 47*b* may pair up and interlock with the second rotation transmitting arm 41*b*.

The lever unit 43 may rotate around the rotation transmitting unit 41 depending on the rotation of the rotation transmitting unit 41 in respect to the support frame 10.

The lever unit 43 may consist of lever half 1 43*a* and lever half 2 43*b* arranged in a mirroring position, and the lever half 1 43*a* may be connected to the lower end of the first rotation transmitting arm 41*a* and the lever half 2 43*b* may be connected to the lower end of the second rotation transmitting arm 41*b*.

FIG. 1 is the drawing representing the auto-rotating handle according to first embodiment of the present disclosure, and FIGS. 2 through 6 are the are drawings representing the standby position and rotated position of the auto-rotating handle depending on the embodiment of the present disclosure.

Also, FIG. 7 is the drawing representing the rotation of the link unit according to an embodiment of the present disclosure.

Here, (a) in FIG. 1, FIG. 2, (a) in FIG. 4, (a) in FIG. 5, (a) in FIG. 6, and (a) in FIG. 7 represent the auto-rotating handle 40 in standby position, and (b) in FIG. 1, FIG. 3, (b) in FIG. 4, (b) in FIG. 5, (b) in FIG. 6, and (b) in FIG. 7 represent the auto-rotating handle 40 in rotated position.

Also, in the drawing illustrating the rotated position, the rotation of one side of the rotation transmitting unit 41*a* among the two rotation transmitting units 41 arranged in mirroring position was illustrated to allow convenient estimation of the rotated position, and both rotation transmitting units 41*a* and 41*b* can be moved to the rotated position.

In reference to FIGS. 1 through 7, the auto-rotating handle 40 according to an embodiment of the present embodiment, the rotation transmitting unit 41 may be furnished with the delivery shaft 411 and delivery bar 413.

The delivery shaft 411 may be mounted on the upper frame 131.

The delivery shaft 411 may consist of delivery shaft 1 411*a* connected to the first rotation transmitting arm 41*a* and delivery shaft 2 411*b* connected to the second rotation transmitting arm 41*b*.

The delivery bar 413 may have one side connected to the delivery shaft 411 in a rotatable fashion and the other side may be left free.

The delivery bar 413 may consist of delivery bar 1 413*a* connected to the delivery shaft 1 411*a* and delivery bar 2 413*b* connected to the delivery shaft 2 411*b*.

The lever rotation unit 47 may be furnished with lever rotation shaft 471, lever interlocking bar 473, and link unit 475.

The lever rotation unit 471 may be mounted on the upper frame 131 and arranged nearby the delivery shaft 411. Here, the lever rotation shaft 471 may be positioned a certain preset distance away from the delivery shaft 411, and cause a difference between the rotation path of the delivery bar 413 and the rotation path of the lever interlocking bar 473 to allow the link unit 475 to rotate.

The lever rotation shaft 471 may consist of lever rotation shaft 1 471*a* placed nearby the delivery shaft 1 411*a* and lever rotation shaft 2 471*b* placed nearby the delivery shaft 2 411*b*.

The lever interlocking bar 473 may be connected to the lever rotation shaft 471 in a rotatable fashion.

The lever interlocking bar 473 may consist of lever interlocking bar 1 473*a* connected to the lever rotation shaft 1 471*a* and lever interlocking bar 2 473*b* connected to the lever rotation shaft 2 471*b*.

The link unit 475 may be connected to the lever interlocking bar 473 and delivery bar 413.

The link unit 475 may consist of the intermediate shaft 475*a* which allows the lever interlocking bar 473 to rotate and the grip shaft 475*b* which is connected to allow the lever unit 43 to rotate (refer to FIG. 10).

The lever unit 43 may furnish a shaft connection unit 431 connected to the grip shaft 475*b* and a grip unit 433 which provides a space for the user to grip on that is extended from the shaft connection unit 431.

The shaft connection unit 431 may allow the grip unit 433 to rotate in synchronization of the grip shaft 475*b* when the link unit 475 rotates around the grip shaft 475*b*.

Also, the link unit 475 may be interlocked with the lever interlocking bar 473 to rotate according to the rotation of the delivery bar 413.

The delivery bar 413, from the standby position without application of external force, may be relocated to the rotated position where the rotation occurs around the delivery shaft 411 by being pulled by the user, and return to the standby position once the external force applied by the user is released from the rotated position due to the force of the weight 30.

The link unit 475 may rotate according to the change in distance between the rotation path of the delivery bar 413 based on the delivery shaft 411 and the rotation path of the lever interlocking bar 473 based on the lever rotation shaft 471.

The lever unit 43 may rotate towards the exterior if the length of the lever rotation unit 47 is longer than the length set prior, and rotate towards the interior if the length of the lever rotation unit 47 is shorter than the length set prior. The exterior and interior direction here refers to the direction from the user's perspective. The rotation of the lever unit 43 depending on the length of the lever rotation unit 47 shall be explained in detail in reference to FIGS. 11 and 12.

FIG. 11 is the drawings representing the auto-rotating handle according to the second embodiment of the present disclosure and FIG. 12 is a schematic illustration to explain the auto-rotating handle according to the third embodiment of the present disclosure.

The auto-rotating handle 40 according to the first, second, and third embodiments of the present disclosure, may each respectively have different length of the upper frame 131, position and distance between the delivery shaft 411 and lever rotation shaft 471, length of the lever interlocking bar 473, and shape and direction of the lever unit 43.

For example, the auto-rotating handle 40 according to the second embodiment illustrated in FIG. 11 may feature a length of the lever rotation unit 47 that is shorter the length set prior. Subsequently, the lever rotation shaft 471 may be located in the rear of the delivery shaft 411 based on the position of the user. When the user pulls the lever unit 43 illustrated in the second embodiment, the link unit 475 may rotate towards the exterior depending on the difference between the rotation path of the rotation transmitting unit 41 and the lever rotation unit 47. Depending on the rotation towards the exterior by the link unit 475, the lever unit 43 may rotate towards the interior (rotating towards the body of the user).

Also, the auto-rotating handle according to the third embodiment illustrated in FIG. 12 may feature a length of the lever rotation unit 47 that is longer the length set prior. Subsequently, the lever rotation shaft 471 may be located in the front of the delivery shaft 411 based on the position of the user. When the user pulls the lever unit 43 illustrated in the second embodiment, the link unit 475 may rotate towards the interior depending on the difference between the rotation path of the rotation transmitting unit 41 and the lever rotation unit 47. Depending on the rotation towards the interior by the link unit 475, the lever unit 43 may rotate towards the interior (rotating towards the exterior of the exercise equipment). Also, the lever rotation unit 47 of the third embodiment may feature a more curved shape that then lever rotation unit 47 of the second embodiment to avoid interference.

As the lever unit 43 of the auto-rotating handle 40 rotates towards the interior or the exterior, there could be the effect of stimulating certain areas of the body even more during exercise.

Meanwhile, the support frame 10 may be furnished with the rotation transmission support unit 19 which supports the delivery bar 413 from the standby position.

The opposing surface to the rotation transmission support unit 19 and the delivery bar 413 is covered with buffer material which allows minimization of damage and impairment of the delivery bar 413 even through rapid repositioning of the delivery bar 413 to the standby position from the rotated position.

FIGS. 8 and 9 are the drawings representing the delivery pulley unit and cable according to an embodiment of the present disclosure.

According to FIGS. 8 and 9, the auto-rotating handle 40 according to an embodiment of the present disclosure can be furnished with additional delivery pulley units.

The delivery pulley unit may determine the movement path of the cable 45 and interlock the rotation transmitting unit 41 and the weight 30 through the cable 45.

The delivery pulley unit may be equipped with the support pulley unit 491, weight pulley unit 493, and Rotation pulley unit 495.

The support pulley unit 491 may be mounted on the upper portion of the weight frame 11.

The support pulley unit 491 may consist of the support pulley half 1 491*a* and support pulley half 2 491*b*.

The weight pulley 493 may be connected to the weight 30.

The Rotation pulley unit may be mounted on the rotation transmitting unit 41.

The Rotation pulley unit 495 may consist of first rotation transmitting arm 41*a* on First half of rotation pulley unit 495*a* and second rotation transmitting arm 41*b* on Second half of rotation pulley unit 495*b*.

The cable 45 may have one end fixed to the case of the support pulley half 1 491*a* and the other end fixed to the case of the support pulley half 2 491*b*.

Also, the cable 45 may have its one-end fixed to its other end through the First half of rotation pulley unit 495*a*, support pulley half 1 491*a*, weight pulley unit 493, support pulley half 2 491*b*, and Second half of rotation pulley unit 495*b*.

While the composition and characteristics of the present disclosure were described based on the embodiments thereof, the composition and characteristics of the present disclosure are not to be restricted by the embodiments. It will be understood by those skilled in the technical field to which the present disclosure belongs to that various changes and modifications may be made without departing from the technical idea and scope of the present disclosure, and such changes or modifications belong to the claims of the present disclosure attached.

DESCRIPTION OF REFERENCE NUMERALS

1: Exercise equipment (seated row)
10: Support frame
20: Seat
30: Weight
40: Auto-rotating handle
41: Rotation transmitting unit
43: Lever unit
46: Cable
47: Lever rotation unit
491: Support pulley unit
493: Weight pulley unit
495: Rotation pulley unit

What is claimed is:

1. An auto-rotating handle for an exercise apparatus, comprising:

a first rotation transmitting unit (41*a*) rotatably connected to an upper frame (131);

a second rotation transmitting unit (41*b*) rotatably connected to the upper frame (131);

a first lever unit (43*a*) connected to one end of the first rotation transmitting unit (41*a*) and providing a grip space for a user;

a second lever unit (43*b*) connected to one end of the second rotation transmitting unit (41*b*) and providing a grip space for the user;

a cable (45) having a first cable connecting the first rotation transmitting unit (41*a*) to a weight and a second cable connecting the second rotation transmitting unit (41*b*) to the weight;

a first lever rotation unit (47*a*) rotatably connected to the upper frame (131) and interlocked with rotation of the first rotation transmitting unit (41*a*); and a second lever rotation unit (47*b*) rotatably connected to the upper frame (131) and interlocked with rotation of the second rotation transmitting unit (41*b*), wherein each of the first and second lever rotation units (47*a*, 47*b*) allows the respective lever unit (43*a*, 43*b*) to rotate about the respective rotation transmitting unit (41*a*, 41*b*) in response to rotation of the respective rotation transmitting unit (41*a*, 41*b*).

2. The auto-rotating handle of claim 1, wherein:

the first rotation transmitting unit (41*a*) includes a first delivery shaft (411*a*) configured to be mounted on the upper frame (131) and a first delivery bar (413*a*) having one end rotatably connected to the first delivery shaft (411*a*) and an opposite end connected to the first lever unit (43*a*);

the second rotation transmitting unit (41*b*) includes a second delivery shaft (411*b*) configured to be mounted on the upper frame (131) and a second delivery bar (413*b*) having one end rotatably connected to the second delivery shaft (411*b*) and an opposite end connected to the second lever unit (43*b*);

the first lever rotation unit (47*a*) includes a first lever rotation shaft (471*a*) configured to be mounted on the upper frame (131) and a first lever interlocking bar (473*a*) rotatably connected to the first lever rotation shaft (471*a*); and the second lever rotation unit (47*b*) includes a second lever rotation shaft (471*b*) configured to be mounted on the upper frame (131) and a second lever interlocking bar (473*b*) rotatably connected to the second lever rotation shaft (471*b*).

3. The auto-rotating handle of claim 2, wherein:

the first lever unit (43*a*) includes a shaft connection unit (431) connected to a grip shaft (475*b*), and a grip unit (433) extending from the shaft connection unit (431) to provide a grip space for the user.

4. The auto-rotating handle of claim 3, wherein each of the first and second delivery bars (413*a*, 413*b*) is rotated from a standby position to a rotated position when an external force is applied by the user, and rotates back to the standby position from the rotated position by the weight when the external force is not applied, the standby position being a position of each delivery bar when no external force is applied and the rotated position being a position of each delivery bar after rotation around the respective delivery shaft (411*a*, 411*b*) upon being pulled by the user.

5. The auto-rotating handle of claim 4, wherein each of the first and second lever units (43*a*, 43*b*) rotates in an outward direction away from the user when the lever rotation units (47*a*, 47*b*) are positioned forward of the delivery shafts.

* * * * *